US011215073B2

(12) United States Patent
Klingels

(10) Patent No.: US 11,215,073 B2
(45) Date of Patent: Jan. 4, 2022

(54) STATOR VANE FOR A TURBINE OF A TURBOMACHINE

(71) Applicant: MTU Aero Engines AG, Munich (DE)

(72) Inventor: Hermann Klingels, Dachau (DE)

(73) Assignee: MTU Aero Engines AG, Munich (DE)

( * ) Notice: Subject to any disclaimer, the term of this patent is extended or adjusted under 35 U.S.C. 154(b) by 251 days.

(21) Appl. No.: 16/382,471

(22) Filed: Apr. 12, 2019

(65) Prior Publication Data

US 2019/0331000 A1 Oct. 31, 2019

(30) Foreign Application Priority Data

Apr. 24, 2018 (DE) ..... 102018206259.5

(51) Int. Cl.
*F01D 25/12* (2006.01)
*F01D 9/04* (2006.01)

(52) U.S. Cl.
CPC ..... *F01D 25/12* (2013.01); *F01D 9/041* (2013.01); *F05D 2240/125* (2013.01); *F05D 2260/201* (2013.01)

(58) Field of Classification Search
CPC ..... F01D 25/12; F01D 9/041; F01D 11/10; F01D 11/001; F01D 9/065; F01D 11/06; F05D 2240/125; F05D 2260/201
See application file for complete search history.

(56) References Cited

U.S. PATENT DOCUMENTS 3,746,462 A * 7/1973 Fukuda ..... F01D 11/10 415/115
5,316,437 A 5/1994 Czachor et al.
9,759,092 B2 9/2017 Moreton et al.
2003/0167775 A1 9/2003 Soechting et al.
2010/0150700 A1 6/2010 Strecker et al.
(Continued)

FOREIGN PATENT DOCUMENTS

DE 2134514 1/1972
DE 102015111843 1/2017
(Continued)

OTHER PUBLICATIONS

AZoM: "Super Alloy Udimet 720TM,", Jan. 2, 2013.
AZoM: "Super Alloy Nimonic 90 TM (UNS N07090)," Nov. 22, 2012.
AZoM: Super Alloy Nimonic 115TM, Nov. 29, 2012.

*Primary Examiner* — Aaron R Eastman
(74) *Attorney, Agent, or Firm* — Davidson, Davidson & Kappel, LLC

(57) ABSTRACT

A stator vane (3) for a turbine (50*c*) of a turbomachine (50), the stator vane having a stator vane airfoil (3*c*), an inner shroud (3*a*) and an outer shroud (3*b*), the inner shroud (3*a*) and the outer shroud (3*b*) bounding an annular space (2), in which working gas (51) is conveyed during operation, radially with respect to a longitudinal axis (52) of the turbomachine (50), and the stator vane airfoil (3*c*) having a stator vane airfoil channel (3*d*) extending through its interior between a radially inner inlet (6) and a radially outer outlet (7). A characteristic features is that the inlet (6) is disposed in such a manner that a gas (8) flowing through the stator vane airfoil channel (3*d*) during operation is at least partially formed of the working gas (51) conveyed in the annular space (2), and thus the working gas is redistributed from radially inward to radially outward.

14 Claims, 3 Drawing Sheets

(56) References Cited

U.S. PATENT DOCUMENTS

| | | | | |
|---|---|---|---|---|
| 2014/0219788 | A1* | 8/2014 | Nilsson | B23P 11/02 415/175 |
| 2016/0003074 | A1 | 1/2016 | Chlus | |
| 2017/0022836 | A1 | 1/2017 | Negulescu et al. | |
| 2017/0044906 | A1* | 2/2017 | Mongillo | F01D 5/189 |
| 2017/0226893 | A1 | 8/2017 | Slavens et al. | |
| 2017/0234144 | A1 | 8/2017 | Mugglestone | |
| 2018/0209285 | A1* | 7/2018 | Kottilingam | F01D 9/065 |

FOREIGN PATENT DOCUMENTS

| | | | |
|---|---|---|---|
| EP | 2 149 676 | A1 | 2/2010 |
| EP | 2 702 251 | B1 | 6/2016 |
| EP | 3 075 964 | A1 | 10/2016 |
| EP | 3 112 596 | | 1/2017 |
| EP | 3 130 756 | A1 | 2/2017 |
| EP | 3 144 479 | A1 | 3/2017 |
| EP | 3 184 750 | A1 | 6/2017 |
| GB | 744548 | | 2/1956 |
| WO | WO95/04225 | A1 | 2/1995 |
| WO | WO2013/165281 | A1 | 11/2013 |
| WO | WO 2016/030157 | | 3/2016 |

* cited by examiner

STATOR VANE FOR A TURBINE OF A TURBOMACHINE

This claims the benefit of German Patent Application DE102018206259.5, filed Apr. 24, 2018 and hereby incorporated by reference herein.

The present invention relates to a stator vane for a turbine of an axial turbomachine.

BACKGROUND

The turbomachine may be, for example, a jet engine, such as a turbofan engine. The turbomachine is functionally divided into a compressor, a combustor and a turbine. In the case of the jet engine, for example, intake air is compressed by the compressor and mixed and burned with jet fuel in the downstream combustor. The resulting hot gas, a mixture of combustion gas and air, flows through the downstream turbine and is expanded therein. The hot gas, also referred to as working gas, flows through a volume on a path from the combustor via the turbine to the nozzle. The present discussion initially considers a stator vane or a turbine module, and thus a portion of this path or volume that will hereinafter be referred to as "annular space."

The stator vane in question has a stator vane airfoil extending between an inner shroud and an outer shroud. The shrouds radially bound the annular space in which the working gas flowing around the stator vane airfoil is conveyed. The following initially makes reference to a stator vane, which then is part of a stator vane ring having a plurality of stator vanes therearound, which are typically identical in construction. Like the reference to a jet engine, this is intended to initially illustrate the present subject matter, but not to limit the generality of the inventive concept. The turbomachine may also be, for example, a stationary gas turbine.

SUMMARY OF THE INVENTION

It is an object of the present invention to provide a particularly advantageous stator vane as well as an advantageous turbine module having such a stator vane.

The present invention provides a stator vane and a turbine module. The stator vane is configured as a hollow vane; i.e., it has a stator vane airfoil channel extending through its interior between a radially inner inlet and a radially outer outlet. Hollow vanes are, per se, known, namely as components through which a cooling fluid flows for cooling purposes. A distinctive feature here is that the inlet is positioned in such a manner that the gas that flows through the stator vane airfoil channel during operation is at least partially formed of the working gas conveyed in the annular space. Accordingly, the working gas is redistributed from radially inward to radially outward.

This redistribution can be advantageous, in the first place, with regard to temperature balance. This is because the temperatures in the (radially outer) casing region are usually significantly higher than in the (radially inner) hub region. As a result, tip clearances can grow to a greater extent in the radially outer region over the service life, whereby the energy conversion is further reduced there. In addition, tip clearances also cause flow losses (tip clearance flow). In accordance with the inventive subject matter, cooler working gas is conveyed from radially inward to radially outward through the stator vane airfoil channel. In a prior art design, hot working gas flows around the outer shroud of the rotor blade disposed downstream of the stator vane, whereby the outer shroud is strongly heated, which can cause mechanical problems. The high centrifugal loads in combination with high temperatures lead to high creep strains. An advantage can be obtained here by reducing the temperature at the outer shroud of the rotor blade. It is generally advantageous to lower the temperature level in the casing region.

As will be discussed in detail below, the redistributed gas may also contain a sealing fluid as a portion thereof, the sealing fluid being injected radially inwardly of the inner shroud in order to shield the rotor disks from the high temperatures in the annular space. With regard to equalizing the radial temperature gradient, this can be advantageous in that the sealing fluid is generally significantly cooler than the working gas (e.g., compressor air); i.e., in that not only working gas is redistributed, but rather an altogether cooler gas is conveyed radially outward. Suctioning off the sealing fluid where it flows into the annular space in the radially inner region thereof can also be advantageous from an aerodynamic standpoint, and thus with regard to efficiency. This is because the inflowing sealing fluid has a significantly different velocity and direction than the working gas conveyed in the annular space and if not suctioned off would significantly disturb the mainstream flow. Figuratively speaking, an aerodynamically problematic boundary layer is suctioned off in the radially inner region of the annular space (generally together with a sealing fluid, see below), which can reduce the disturbance of the mainstream flow. Accordingly, the arrangement according to the invention makes it possible to prevent a drop in efficiency in the region of the hub.

Preferred embodiments will be apparent from description. In the description of the features, a distinction is not always drawn specifically between apparatus, device and use aspects. In any case, the disclosure should be read to imply all claim categories. In particular, the disclosure always relates to both the stator vane and a turbine module having such a stator vane, as well as to corresponding uses.

In the context of the present disclosure, "axial" generally relates to the longitudinal axis of the turbine module, and thus to the longitudinal axis of the turbomachine, which coincides, for example, with an axis of rotation of the rotors. "Radial" refers to the radial directions that are perpendicular thereto and point away therefrom; and a "rotation," respectively "rotating" or the "direction of rotation" relate to the rotation about the longitudinal axis. In the context of the present disclosure, "a" and "an" are to be read as indefinite articles and thus always also as "at least one," unless expressly stated otherwise. Thus, for example, the stator vane ring having the stator vane airfoil according to the present invention has a plurality of such airfoils, which are disposed, for example, in rotational symmetry around the longitudinal axis. Also, a plurality of stator vanes may be integral with one another; i.e., combined to form a stator vane segment, which may then include, for example, 2, 3, 4, 5 or 6 vanes.

When viewed with respect to the flow of working gas, the stator vane airfoil has a leading edge and a trailing edge as well as two side surfaces, each connecting the leading and trailing edges, one of the side surfaces forming the suction side and the other forming the pressure side. The stator vane airfoil channel is disposed in the interior of the stator vane airfoil. Preferably, the stator vane airfoil channel is free of loops along its extent between the inlet and the outlet, and thus there is exactly one channel in a direction from inward to outward, which directly interconnects the inlet and the outlet.

In a preferred embodiment, the outlet of the stator vane airfoil channel is disposed radially outwardly of the outer shroud. Thus, the gas conveyed from radially inward to outward is at least not directly injected into the annular space, which is advantageous from an aerodynamic standpoint. Nevertheless, it is possible to achieve cooling of the casing region.

In a preferred embodiment, the outlet is offset from the trailing edge of the stator vane airfoil in the downstream direction. The terms "downstream" and "upstream" generally relate to the flow of the working gas in the annular space, unless expressly stated otherwise. With the rearwardly offset outlet, it can in particular be achieved that the gas that is conveyed radially outward flows over the outer shroud of the downstream rotor blade(s) (see below for more details).

In a preferred embodiment, the inlet of the stator vane airfoil channel is disposed at an upstream-pointing leading edge of the stator vane. While inflow of working gas from the annular space could generally also be achieved with an inlet that is disposed in the shroud itself, its disposition at the leading edge can be advantageous, for example, with regard to the inflow of a portion of the sealing fluid.

The present invention also relates to a turbine module having a stator vane as disclosed herein, which preferably is a low-pressure turbine module.

In a preferred embodiment of the turbine module, a rotor blade is disposed upstream of the stator vane. Analogously to the stator vane, the rotor blade is generally part of a ring having a plurality of identically constructed and rotationally symmetric airfoils. An inner shroud of the upstream rotor blade and the inner shroud of the stator vane then together form a labyrinth seal, to which a sealing fluid is fed from radially inside (the labyrinth seal is referred to as "seal" because it serves to shield the rotor disks in the region of the hub, see above). Specifically, the labyrinth seal is formed by an axial overlap of a downstream trailing edge of the inner shroud of the rotor blade with an upstream leading edge of the inner shroud of the stator vane, the trailing edge of the inner shroud of the rotor blade preferably being disposed radially inwardly of the leading edge of the inner shroud of the stator vane.

In a preferred embodiment, a sealing fin is provided as part of the labyrinth seal radially inwardly of the inner shroud of the stator vane. This sealing fin typically extends axially forwardly away from a seal carrier wall and preferably axially overlaps the trailing edge of the inner shroud of the rotor blade. Thus, said trailing edge is radially embraced between the sealing fin and the leading edge of the inner shroud of the stator vane, which is why this arrangement is also referred to as "fish mouth seal." When viewed in an axial section, the sealing fluid then flows through the labyrinth seal from radially inward to radially outward along an S-shaped path.

As mentioned earlier, an advantage of the inventive subject matter may lie in that this sealing fluid, which is introduced for shielding the rotor hub, is at least partially suctioned off through the inlet, so that the mainstream flow in the annular space is not significantly disturbed. Despite this removal by suction, the sealing fluid flows through the described overlap regions, and thus the hub region is sealed from the working gas. Considering the rotor blade ring or stator vane ring as a whole, the overlaps mentioned ideally exist independently of the axial position of the rotor relative to the stator.

In a preferred embodiment, as mentioned, a portion of the gas flowing through the stator vane airfoil channel during operation is sealing fluid suctioned off at the inlet. Nevertheless, however, the greater part of the gas that is conveyed radially outward is preferably working gas suctioned off in the annular space.

A preferred embodiment relates to a turbine module having a rotor blade disposed downstream of the stator vane, or a corresponding rotor blade ring. The downstream rotor blade has a rotor blade airfoil extending between a (radially) inner shroud and a (radially) outer shroud. The outlet of the stator vane airfoil channel is then advantageously disposed in such a manner that the gas that is conveyed outwardly is by-passed radially outwardly of the outer shroud of the rotor blade, or flows around the outer shroud, downstream of the outlet (of course, not all of the gas that is conveyed outwardly needs to flow outwardly of the outer shroud). Thus, at least the major part of the gas is not blown out into the annular space, but into the region outside the outer shrouds on the outside of the main flow passage. It is thereby already possible, on the one hand, to achieve cooling of this region.

On the other hand, in a preferred embodiment, the amount of gas is selected such that only the gas that is conveyed radially outward flows over the outer shroud of the rotor blade. Conversely, this means that no working gas from the boundary layers of the annular space flows over the outer shrouds, which can be thermally advantageous (the outer shroud heats up less), but can also mean, in particular, that the mainstream flow is disturbed less. Thus, ideally, it is also possible to improve the efficiency locally.

In a preferred embodiment, the outlet of the stator vane airfoil channel is provided in such a manner that the exiting gas is fanned-out; i.e., divergent, in the direction of rotation. Accordingly, the effects just mentioned can then, for example, not only be achieved axially in alignment with the stator vane airfoil(s), but ideally over substantially the entire circumference.

In a preferred embodiment, the outlet of the stator vane airfoil channel is provided in such a manner that the exiting gas differs in velocity and/or direction from the working gas conveyed in the annular space; i.e., from the velocity and/or direction of the working gas in this radially outer region of the annular space. The flow characteristics of the gas that is conveyed radially outward can be adjusted independently of the working gas. For example, a circumferential component of the exiting gas velocity may be less than the rotational speed of the downstream rotor shroud.

In general, the flow through the stator vane airfoil channel; i.e., suctioning at a radially inner position and blowing out at a radially outer position, is caused by a pressure difference across the stator vane. The velocity can be set via the size (the cross-sectional area) of the outlet; the orientation determines the direction of the exiting fluid flow. This opens up the described design options to the effect that flow losses in the annular space, and thus efficiency losses, can be reduced. Friction losses, and thus local heating, e.g., of the outer shroud, can also be minimized.

Preferably, the turbine module has a plurality of stages, each having a stator vane ring and a downstream rotor blade ring. Preferably, the stator vanes in all stages of the turbine are then provided with corresponding stator vane airfoil channels, so that an overall lower temperature is attained in the casing region. The cooling air requirement in the casing decreases and, in addition, the gap stability may be improved.

In a preferred embodiment, a rotor blade airfoil disposed downstream of the stator vane with the stator vane airfoil channel is made of a forging (or forged) material, e.g., of UDIMET720™ (a super-alloy made of nickel, chromium cobalt, titanium, molybdenum, aluminum, and other materials), NIMONIC90™ (a super-alloy made of nickel, chromium cobalt, titanium and aluminum) or NIMONIC115™ (a super-alloy made of nickel, chromium cobalt, aluminum, molybdenum, titanium and other materials) Preferably, the entire rotor blade is made of a forging material.

Due to, for example, better strength characteristics compared to a casting material, a forging material may generally be of interest, for example with regard to tensile strength, yield strength, HCF, LCF, impact strength, fracture strain, etc. Therefore, the use of a forging material may be of interest, particularly in the rear stages of the turbine or low-pressure turbine. However, in prior-art turbines, the temperatures are generally still too high to allow this, which is why temperature-resistant casting materials are used. Using the approach of the present invention, the temperatures can be reduced, in particular in the radially outer region, which can already be advantageous in terms of increased service life, but in addition enables the use of other materials. It is preferred to use forging materials.

Another preferred embodiment also relates to the use of a forging material, of which the entire turbine blisk is then made. This means that the rotor disk including the rotor blades formed integrally therewith is comprised of the forging material.

The present invention also relates to the use of a turbine module as described herein, in particular for an axial turbomachine, preferably a jet engine. In such use, on the one hand, the working gas flows through the annular space and, on the other hand, gas is redistributed from radially inward to radially outward through the stator vane airfoil channel, the latter gas being formed at least partially of working gas and, preferably, partially also of sealing fluid.

BRIEF DESCRIPTION OF THE DRAWINGS

The present invention will now be explained in more detail with reference to an exemplary embodiment. The individual features may also be essential to the invention in other combinations within the scope of the other independent claims, and, as above, no distinction is specifically made between different claim categories.

In the drawing.

DETAILED DESCRIPTION OF PREFERRED EMBODIMENTS

Figure 2:
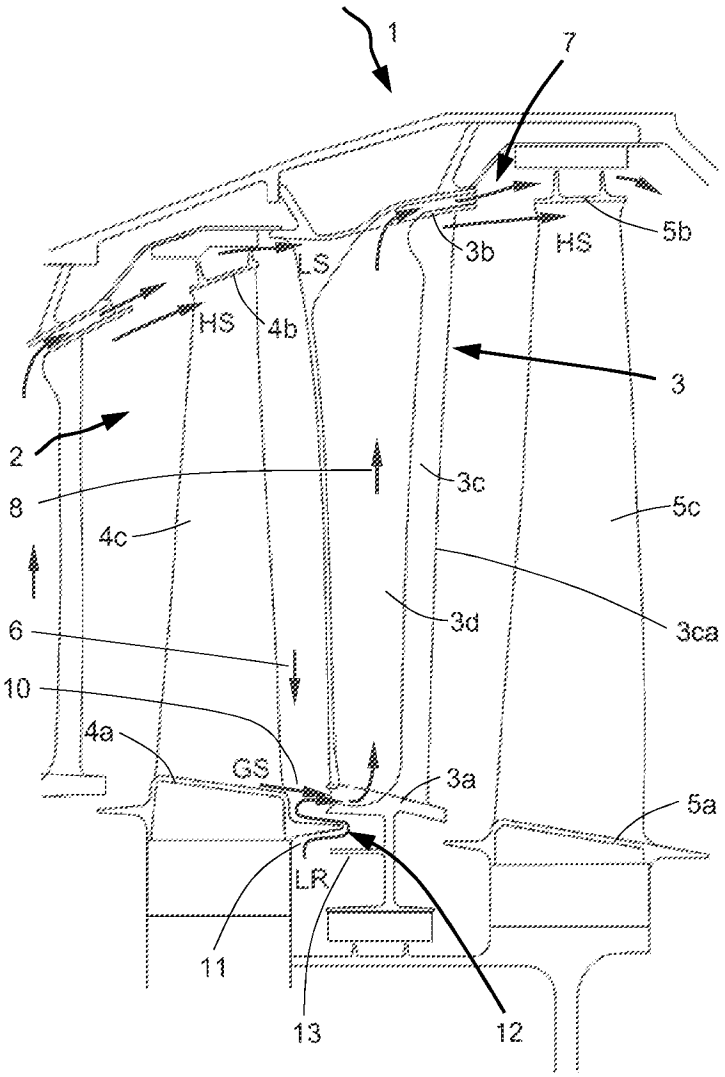
FIG. 2 shows an axial cross-sectional view of a turbine module having a stator vane provided with a stator vane airfoil channel, according to the present invention.

FIG. 2 shows, in axial cross-sectional view, a portion of a turbine module 1. During operation, working gas traveling from the combustor (located to the left of turbine module 1) to the nozzle (located to the right thereof) flows through an annular space 2 formed by turbine module 1 (see also FIG. 5 for illustration). Disposed in this annular space 2 is a stator vane 3 having an inner shroud 3*a*, an outer shroud 3*b*, and a stator vane airfoil 3*c* therebetween. A rotor blade 4 is disposed upstream of stator vane 3; a rotor blade 5 is disposed downstream thereof. Stator vane 3 is shown in cross-section. A stator vane airfoil channel 3*d* extends from radially inward to radially outward through stator vane airfoil 3*c*. The inlet 6 into stator vane airfoil channel 3*d* is located at inner shroud 3*a* of stator vane 3, and specifically at the upstream leading edge thereof. The outlet 7 of stator vane airfoil channel 3*d* is disposed radially outwardly of the outer shroud 3*b* and is axially offset in the downstream direction from trailing edge 3*ca* of stator vane airfoil 3*c*.

Due to the pressure difference across stator vane 3, suctioning occurs at a radially inner position, at inlet 6, and blowing out occurs at a radially outer position, at outlet 7. Inlet 6 is disposed such that the gas 8 flowing through stator vane airfoil channel 3*d* is at least partially formed of the working gas conveyed in annular space 2. Specifically, an endwall boundary layer 10 of the mainstream flow is suctioned off. This is advantageous from an aerodynamic standpoint alone, and, in addition, the temperatures in the annular space are lower radially inwardly than radially outwardly, and thus an excessive temperature gradient can be prevented by the redistribution.

Furthermore, a sealing fluid 11, which is introduced in the radially inner region to shield the hub region and flows through a labyrinth seal 12, is also partially suctioned in through inlet 6. The labyrinth seal is formed by an axial overlap of a sealing fin 13, inner shroud 4*a* of rotor blade 4, and specifically the trailing edge thereof, and inner shroud 3*a* of stator vane 3, and specifically the leading edge thereof. This sealing fluid 11 is significantly cooler compressor air, whose radially outward redistribution through stator vane airfoil channel 3*d* is advantageous with regard to preventing excessive temperature gradients.

Figure 1:
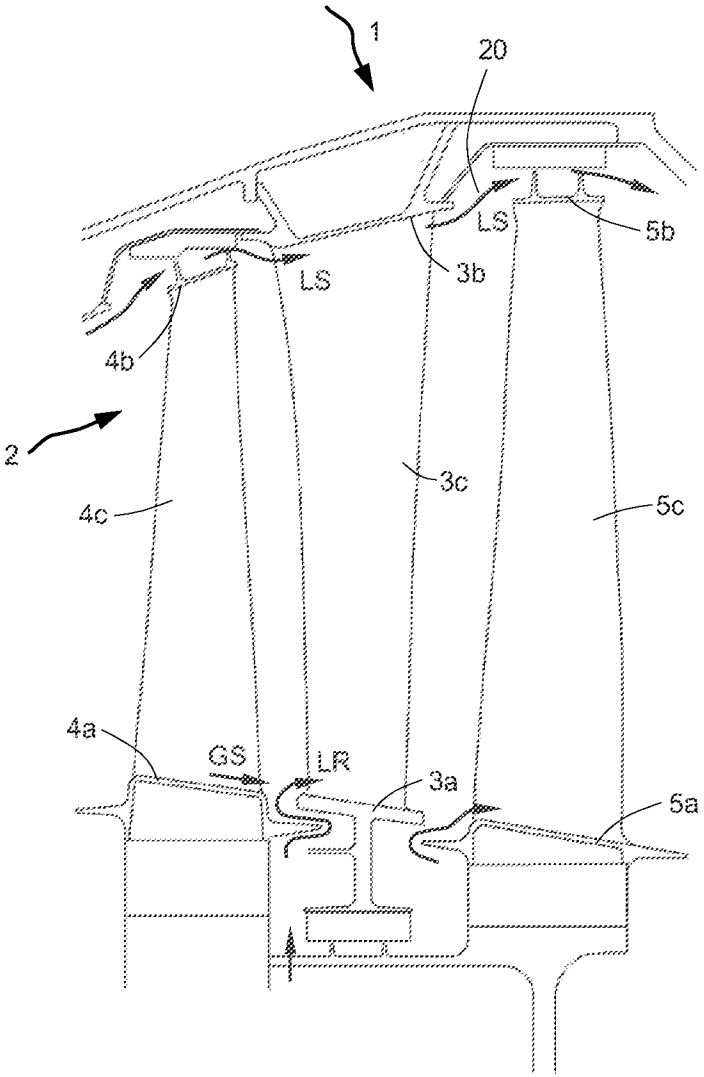
FIG. 1 shows, in comparison to FIG. 2, a variant without a stator vane airfoil channel to illustrate the advantages achieved by the present invention.

In comparison, FIG. 1 shows a turbine module 1 having an analogously configured labyrinth seal 12. However, unlike FIG. 2, stator vane airfoil 3*c* is not provided with a stator vane airfoil channel 3*d*. Accordingly, sealing fluid 11 flows into annular space 2, disturbing the mainstream flow therein. In addition, endwall boundary layers 10 generally suffer from aerodynamic issues anyway; i.e., overall, flow losses and efficiency losses are likely to occur (compared to the variant shown in FIG. 2). FIG. 1 further illustrates that there is also a leakage flow 20 in the radially outward region, the leakage flow flowing over outer shrouds 4*b*, 5*b* of rotor blades 4, 5. This, too, results in a disturbance of the mainstream flow.

In the inventive design, this is avoided by positioning outlet 7 of stator vane airfoil channel 3*d* in such a way that the gas 8 conveyed radially outward flows over outer shroud 5*b* of rotor blade 5. The amount is selected such that no working gas from annular space 2 flows over outer shroud 5*b*. As can be seen FIG. 2, this applies analogously to the upstream turbine stage. However, for the sake of clarity, the description refers to the interaction of stator vane 3 with rotor blade 5.

Figure 3:
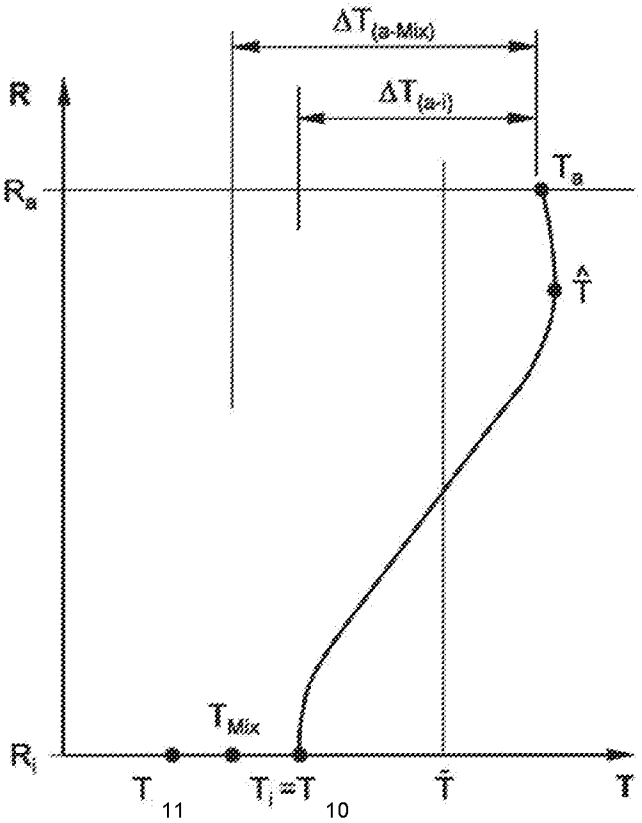
FIG. 3 shows a diagram illustrating the radial temperature profile.

FIG. 3 illustrates a radial temperature profile as arises in a turbine module 1 according to FIG. 1; i.e., without redistribution through stator vane airfoil channel 3*d*. Temperature T is plotted on the x-axis; the radius taken in a direction away from the inner shroud is plotted on the y-axis. The solid line represents the temperature of the working gas, which is primarily determined by the temperature profile at the combustor exit. The temperature increases radially outwardly (see also the introductory part of the description).

Figure 4:
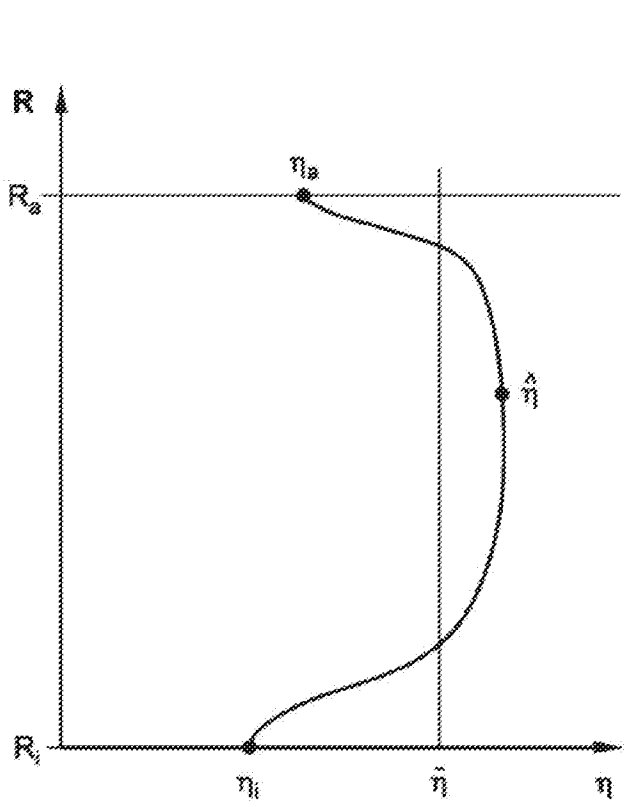
FIG. 4 shows a diagram illustrating the radial efficiency profile.

FIG. 4 illustrates the efficiency q (x-axis) in relation to radius R (y-axis). A drop in efficiency in the radially inner region and in the radially outer region, inter alia, occurs because of boundary layer flow 10 and leakage flow 20. In addition to this, a disturbance is caused by the sealing fluid 11 flowing into the annular space in the radially inner region. A can be seen from FIG. 3, sealing fluid 11 has a significantly lower temperature than the working gas there (see point $T_{11}$ on the x-axis). Thus, when sealing fluid 11 flows into annular space 2, a mixture temperature $T_{Mix}$ arises there, so that temperature gradient ($\Delta T_{(a\text{-}Mix)}$) is even greater than when considering the working gas alone ($\Delta T_{(a\text{-}i)}$).

As explained above, with the approach of the present invention, the cooler sealing fluid 11 and, in addition, cooler working gas are redistributed from radially inward to radially outward, so that the temperature gradients can be reduced. As a result of the reduced disturbance of the mainstream flow in the radially inner and radially outer regions, an improved efficiency profile can be achieved as well.

Figure 5:
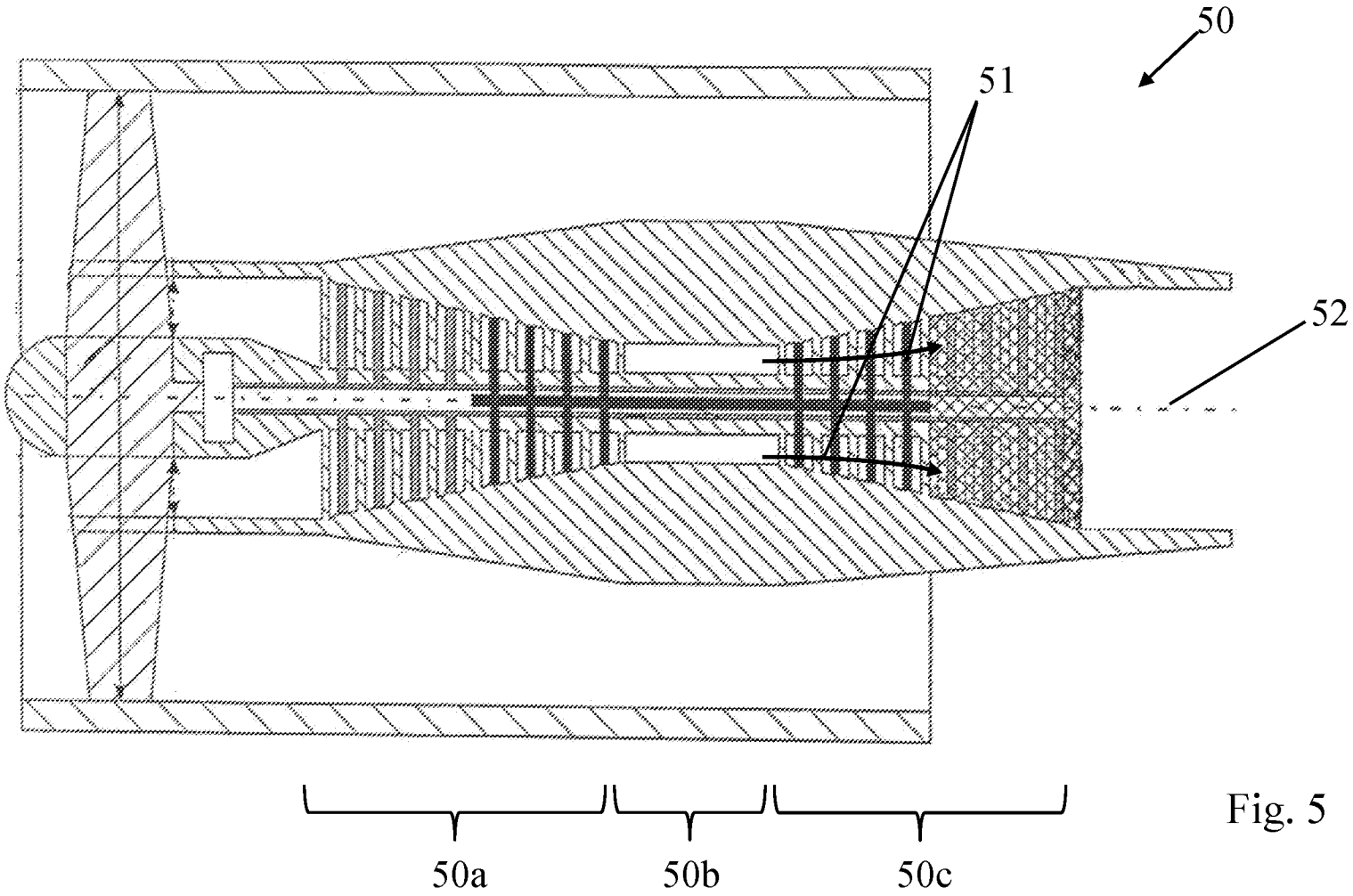
FIG. 5 shows an axial cross-sectional view of a turbomachine having a turbine module as shown in FIG. 2.

FIG. 5 shows, in axial cross-sectional view, a turbomachine 50, specifically a jet engine. Turbomachine 50 is functionally divided into a compressor 50*a*, a combustor 50*b* and a turbine 50*c*. Both compressor 50*a* and turbine 50*c* are made up of a plurality of components or stages, each stage being composed of a stator vane ring and a rotor blade ring. The rotor blade rings are driven by working gas 51 and rotate about longitudinal axis 52 of turbomachine 50. The aforedescribed turbine module 1 is part of turbine 50*c*, and specifically forms the low-pressure turbine.

LIST OF REFERENCE NUMERALS turbine module 1
annular space 2
stator vane 3
inner shroud 3*a*
outer shroud 3*b*
stator vane airfoil 3*c*
trailing edge 3*ca*
stator vane airfoil channel 3*d*
rotor blade (upstream) 4
inner shroud 4*a*
outer shroud 4*b*
rotor blade airfoil 4*c*
rotor blade (downstream) 5
inner shroud 5*a*
outer shroud 5*b*
rotor blade airfoil 5*c*
inlet 6
outlet 7
gas 8
endwall boundary layer/boundary layer flow
sealing fluid 11
labyrinth seal 12
sealing fin 13
leakage flow 20
turbomachine 50
compressor 50*a*
combustor 50*b*
turbine 50*c*
working gas 51
longitudinal axis 52
temperature T
radius R
efficiency η

What is claimed is:

1. A stator vane for a turbine of a turbomachine, the stator vane comprising:

a stator vane airfoil;

an inner shroud; and an outer shroud, the inner shroud and the outer shroud bounding an annular space radially with respect to a longitudinal axis of the turbomachine, working gas conveyed in the annular space during operation;

the stator vane airfoil having a stator vane airfoil channel extending through an interior between a radially inner inlet and a radially outer outlet, the inlet being disposed in such a manner that a gas flowing through the stator vane airfoil channel during operation is at least partially formed of the working gas conveyed in the annular space so that the gas including the working gas is redistributed from radially inward to radially outward;

wherein the inlet of the stator vane airfoil channel is disposed at a leading edge of the inner shroud of the stator vane, the inlet on the leading edge facing in an upstream direction relative to the flow of the working gas through the annular space.

2. The stator vane as recited in claim 1 wherein the outlet of the stator vane airfoil channel is disposed radially outwardly of the outer shroud of the stator vane.

3. The stator vane as recited in claim 2 wherein the outlet of the stator vane airfoil channel is offset from a trailing edge of the stator vane airfoil in a downstream direction relative to the flow of the working gas through the annular space.

4. A turbine module comprising the stator vane as recited in claim 1.

5. The turbine module as recited in claim 4 further comprising a rotor blade disposed upstream of the stator vane relative to the flow of the working gas through the annular space, the rotor blade having a rotor blade inner shroud and a rotor blade airfoil, a downstream-pointing trailing edge of the rotor blade inner shroud having an axial overlap with the leading edge of the inner shroud of the stator vane in order to form a labyrinth seal.

6. The turbine module as recited in claim 5 further comprising a sealing fin disposed radially inwardly of the inner shroud of the stator vane, the sealing fin being provided, as part of the labyrinth seal, radially inwardly of the inner shroud of the stator vane and having an axial overlap therewith.

7. The turbine module as recited in claim 5 wherein the turbine module is designed so that sealing fluid flows through the labyrinth seal from radially inward to radially outward during operation, the sealing fluid at least partially being suctioned off through the inlet of the stator vane airfoil channel and flowing through the stator vane airfoil channel as part of the gas.

8. The turbine module as recited in claim 4 further comprising a rotor blade disposed downstream of the stator vane relative to the flow of the working gas through the annular space, the rotor blade having a rotor blade airfoil as well as a rotor blade inner shroud and a rotor blade outer shroud, the outlet of the stator vane airfoil channel is disposed in such a manner that the gas flowing through the stator vane airfoil channel is at least partially by-passed radially outwardly of the rotor blade outer shroud.

9. The turbine module as recited in claim 8 wherein an amount of the gas that is by-passed radially outwardly of the rotor blade outer shroud is selected such that the amount of gas blocks the working gas from flowing directly out of the annular space and over the outer shroud of the rotor blade.

10. The turbine module as recited in claim 8 wherein the outlet of the stator vane airfoil channel is provided in such a manner that the gas flowing through the stator vane airfoil channel exits divergently from a direction of rotation of the rotor blade.

11. The turbine module as recited in claim 8 wherein the outlet of the stator vane airfoil channel is provided in such a manner that the gas flowing through the stator vane airfoil channel exits at a different velocity or in a different direction than a working gas velocity or direction that the working gas conveyed in the annular space at the outlet.

12. The turbine module as recited in claim 4 further comprising a rotor blade downstream of the stator vane and having a rotor blade airfoil made of a forged material.

13. The turbine module as recited in claim 4 further comprising a rotor blade downstream of the stator vane and part of a disk with integral rotor blades, the disk being made of a forged material.

14. A method for operating the turbine module as recited in claim 4 comprising conveying the working gas in the annular space, and flowing the gas from radially inward to radially outward through the stator vane airfoil channel, the gas being at least partially formed of the working gas conveyed in the annular space so that the gas including the working gas is redistributed from radially inward to radially outward.

* * * * *